US008814331B2

(12) United States Patent
Vilk et al.

(10) Patent No.: US 8,814,331 B2
(45) Date of Patent: Aug. 26, 2014

(54) INKJET SYSTEM WITH BACKPRESSURE CAPACITOR

(75) Inventors: Ran Vilk, Netanya (IL); Roni Mor, Netanya (IL); Golan Moyal, Netanya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 462 days.

(21) Appl. No.: 12/997,521

(22) PCT Filed: Jun. 10, 2008

(86) PCT No.: PCT/IL2008/000781

§ 371 (c)(1), (2), (4) Date: Mar. 7, 2011

(87) PCT Pub. No.: WO2009/150640

PCT Pub. Date: Dec. 17, 2009

(65) Prior Publication Data

US 2011/0181669 A1 Jul. 28, 2011

(51) Int. Cl.
*B41J 2/175* (2006.01)

(52) U.S. Cl.
CPC ..... *B41J 2/175* (2013.01); *B41J 2/17556* (2013.01); *B41J 2/17506* (2013.01); *B41J 2002/17579* (2013.01)
USPC ..... 347/85

(58) Field of Classification Search
CPC .... B41J 2/175; B41J 2/17556; B41J 2/17506; B41J 2002/17579
USPC ..... 347/84–86
See application file for complete search history.

(56) References Cited

U.S. PATENT DOCUMENTS

| | | | | |
|---|---|---|---|---|
| 4,929,963 | A * | 5/1990 | Balazar | 347/89 |
| 5,646,666 | A | 7/1997 | Cowger et al. | |
| 6,247,807 | B1 | 6/2001 | Yang et al. | |
| 6,302,516 | B1 | 10/2001 | Brooks et al. | |
| 6,331,053 | B1 | 12/2001 | Seccombe et al. | |
| 6,398,329 | B1 | 6/2002 | Boyd et al. | |
| 6,428,156 | B1 | 8/2002 | Waller et al. | |
| 6,485,137 | B2 | 11/2002 | Karlinski et al. | |
| 6,543,877 | B1 | 4/2003 | Boutet et al. | |
| 6,722,763 | B1 | 4/2004 | Hsu et al. | |
| 6,773,098 | B2 | 8/2004 | Corby et al. | |
| 7,344,231 | B2 * | 3/2008 | Talon et al. | 347/85 |
| 7,841,706 | B2 * | 11/2010 | Ishinaga et al. | 347/84 |
| 2002/0097284 | A1 * | 7/2002 | Vosahlo | 347/7 |

* cited by examiner

*Primary Examiner* — An Do

(57) ABSTRACT

A vacuum source is coupled to an ink reservoir to establish a backpressure to prevent ink from dripping from a printhead. The vacuum source is also coupled to a backpressure capacitor so that a first liquid-gas interface rises to a first level. When the vacuum source is decoupled, the liquid-gas interface falls to a second level so as to maintain sufficient backpressure on said ink to prevent it from dripping from the inkjet printhead.

20 Claims, 2 Drawing Sheets

INKJET SYSTEM WITH BACKPRESSURE CAPACITOR

RELATED APPLICATIONS

The present application claims the priority under 35 U.S.C. 119(a)-(d) or (f) and under C.F.R. 1.55(a) of previous International Patent Application No.: PCT/IL2008/000781, filed Jun. 10, 2008, entitled "Inkjet System with Backpressure Capacitor", which application is incorporated herein by reference in its entirety.

BACKGROUND OF THE INVENTION

Inkjet printing technology is used in many commercial products such as computer printers, graphics plotters, copiers, and facsimile machines. Herein, "inkjet printer" encompasses all of these devices. Some inkjet printers apply a backpressure to an ink reservoir to prevent ink from dripping from the printhead. In one approach, a vacuum source is used to apply the backpressure. This approach requires a permanently operating vacuum source. When the printer is not operative, e.g., shutdown over a weekend, the vacuum is not maintained. Failure to maintain backpressure causes ink to drip from the printhead and air to ingest into the printhead. In this case, the printhead may need to be re-primed, which is a costly and complicated procedure.

Prior-art backpressure systems based on the difference in the elevation of ink levels at which the interim and main ink supply tanks are placed suffer from ink leakage, since environmental conditions change and in particular temperature affect the ink volume and accordingly the ink level in a non-operating system. There is a need to improve the methods of backpressure generation and provide a method free of the above-mentioned drawbacks.

Herein, related art is described to facilitate understanding of the invention. Related art labeled "prior art" is admitted prior art; related art not labeled "prior art" is not admitted prior art.

BRIEF DESCRIPTION OF THE DRAWINGS

The figures depict implementations/embodiments of the invention and not the invention itself.

DETAILED DESCRIPTION

The present invention provides for using a vacuum system to charge a "backpressure capacitor" while applying backpressure to one or more ink reservoirs to prevent ink from dripping from an inkjet printhead. The term "backpressure capacitor" is applied in view of a functional analogy with an electrical potential capacitor familiar in the electrical arts. Once charged, the backpressure capacitor can provide sufficient backpressure to the ink reservoirs to prevent dripping when the vacuum system is decoupled. This in turn avoids dripping when the vacuum is unintentionally interrupted, and allows the vacuum system to be turned off for extended periods (e.g., to save energy over a weekend) without inducing dripping.

The backpressure capacitor can use a U-shaped tank or other structure that contains a liquid interfacing with both a low-pressure gas and an ambient-pressure gas, while isolating the two gases from each other. While a vacuum pump is operating, the liquid to low-pressure-gas "capacitor" interface rises relative to the liquid to ambient-gas interface so as to store potential energy. When the pump is decoupled from the reservoir and liquid containment structure, the capacitor interface falls; in the process, the volume of the confined low-pressure gas increases and its pressure decreases, limiting the fall of the capacitor interface.

Once equilibrium is reached, a stable backpressure continues to be applied to the ink in the reservoir. If the backpressure established while the vacuum is operating is sufficiently high, and, if the ratio of the area of the capacitor interface to the total area of the ink to low-pressure-gas "ink" interfaces is sufficiently high, the backpressure will prevent ink from dripping from the printhead even though the vacuum is not operating.

Figure 1:
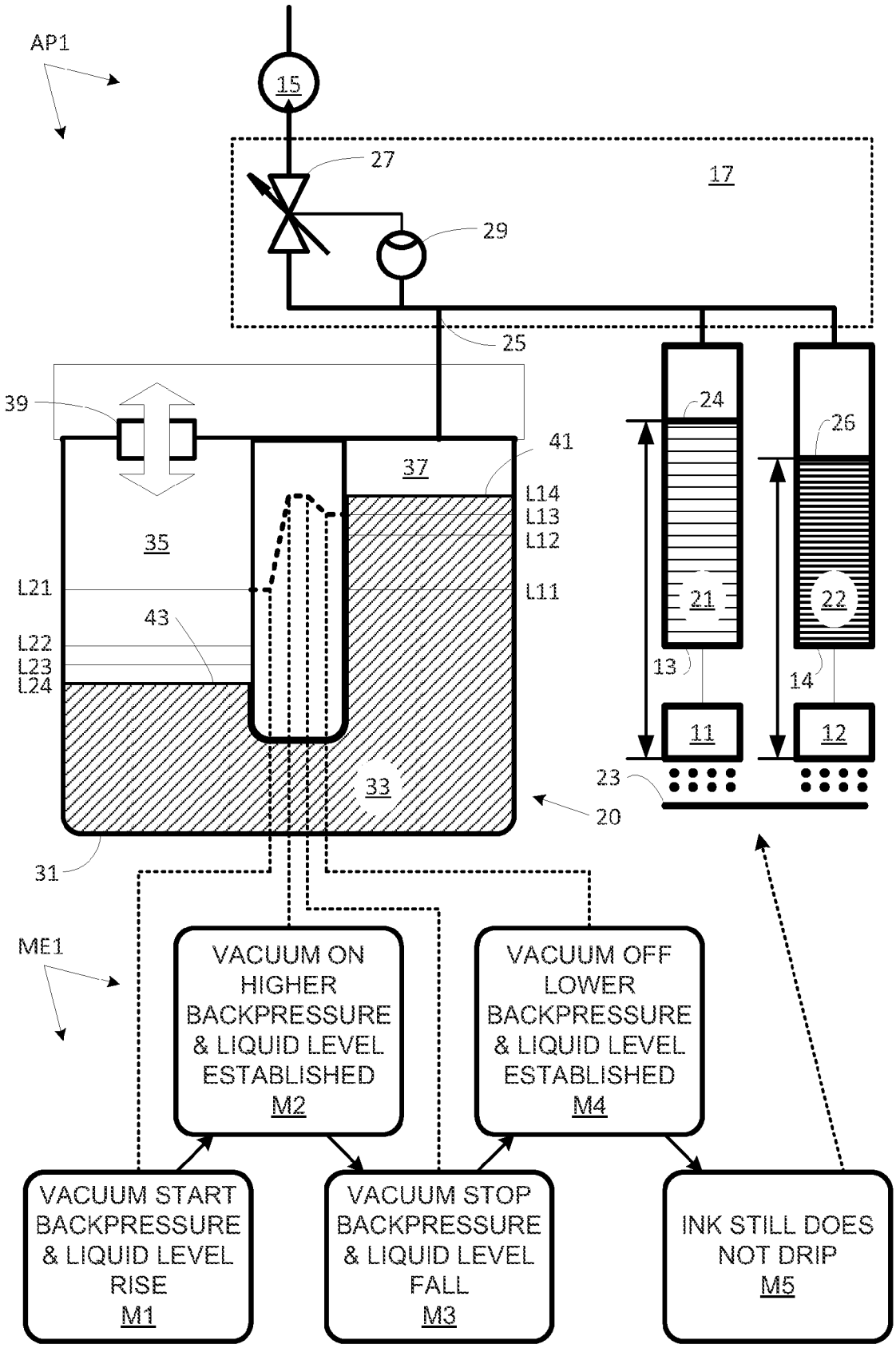
FIG. 1 is a combination schematic diagram, flow chart, and graph depicting an inkjet printing system having a backpressure capacitor and a method in accordance with embodiments of the present invention.

As shown in FIG. 1, an inkjet printing system AP1 comprises printheads 11 and 12, an ink reservoirs 13 and 14, a vacuum pump 15, an exhaust system 17, and a backpressure capacitor 20. Reservoirs 13 and 14 provide respectively colored inks 21 and 22 to respective inkjet printheads 11 and 12, which in turn deliver ink in a precise manner to a print medium 23. Ink 21 forms an ink-gas interface 24, and ink 22 forms an ink-gas interface 26. Pump 15 provides backpressure to reservoirs 13 and 14 to offset the gravity-based pressure from inks 21 and 22 that might otherwise drip out of printheads 11 and 12. While two reservoirs and two printheads are shown, the invention applies as well to systems with other numbers (e.g., 1-1000 and more) of reservoirs and printheads.

Exhaust system 17 provides a conduit structure 25 for coupling pump 15 to reservoirs 13 and 14 and backpressure capacitor 20. Exhaust system 17 also includes a valve 27 for controlling this coupling. When valve 27 is open: 1) pump 15 is in gaseous communication with reservoirs 13 and 14 for applying backpressure to ink 21 therein; and 2) pump 17 is in gaseous communication with backpressure capacitor 20 for "charging" the latter. When valve 27 is closed, pump 15 is decoupled from reservoirs 13 and 14 and backpressure capacitor 20, which remains in gaseous communication with reservoirs 13 and 14.

Exhaust system 17 further includes a pressure sensor 29 for monitoring the gas pressure in conduit structure 17. When it detects a drop in pressure (possibly indicating a pump failure), sensor 29 can shut valve 27 to prevent further loss of backpressure.

Backpressure capacitor 20 includes a U-shaped tank 31 partially filled with liquid 33, e.g., water. Other backpressure capacitors in accordance with embodiments of the invention employ other liquids and other containment structures as described further below.

Liquid 33 interfaces with ambient-pressure gas 35 and low-pressure gas 37. A filter 39 limits contamination of liquid 33 by airborne particulates. Low-pressure gas 37 is isolated from ambient-pressure gas 35 by liquid 33 and exhaust system 17.

FIG. 1 indicates four levels L11, L12, L13, and L14 for capacitor interface 41, and a corresponding four levels L21, L22, L23, and L24 for a liquid-to-ambient-gas "ambient" interface 43. Levels L11 and L21 are the same and represent the levels of interfaces 41 and 43 when both are subjected to ambient pressure (e.g., when tank 31 is first installed). Levels L12 and L22 are the respective levels for interfaces 41 and 43 when the backpressure applied to reservoir 13 (and thus to capacitor interface 41) precisely balances the gravity-based pressure at inkjet head 11. Levels L13 and L23 are the respective levels for interfaces 41 and 43 when the backpressure overcompensates for the gravity-based pressure so that minor perturbations do not cause ink to drip from printheads 11 and 12; these are the interface levels at equilibrium when capacitor 20 is providing backpressure in lieu of pump 15. Levels L14 and L24, which are assumed by liquid 33 as shown in FIG. 1, are the interface levels at equilibrium when pump 15 is providing backpressure to ink 21 and 22 in reservoirs 13 and 14.

A method ME1 in accordance with an embodiment of the invention is represented in the flow chart of FIG. 1. Method ME1 can be practiced in the context of system AP1. For the purposes of this description, method ME1 can be considered beginning with an initial state in which low-pressure gas is at ambient pressure and interfaces 41 and 43 are at levels L11 and L21, respectively.

At method segment M1, vacuum pump 15 is started and valve 27 is set so vacuum pump 15 is coupled to reservoirs 13 and 14 for applying backpressure thereto. Under the action of pump 15, the pressure in exhaust system 17 decreases; capacitor interface 41 rises and ambient interface 43 falls in response to the increasing pressure differential between low-pressure gas 37 and ambient-pressure gas 35.

At method segment M2 equilibrium is reached between the pumping action and the pressure within exhaust system 17. The backpressure applied to ink 21 and 22 is well above that required to ensure that ink does not inadvertently drip from inkjet printheads 11 and 12, but not so high as to interfere with printing. Capacitor interface 41 in tank 31 has risen to and is maintained at level L14; ambient interface 43 has dropped to level L24.

At method segment M3, valve 27 is closed so that vacuum pump 15 is decoupled from reservoirs 13 and 14 and tank 31. This decoupling can be intentional, as the printer may be off or in a low power state, or the vacuum may fail for some reason. In response, the pressure level in exhaust system 17 drops. As a result, capacitor 41 falls and ambient interface 43 rises.

At method segment M4 equilibrium is achieved. Capacitor interface 41 has fallen to level L13, evacuating a volume between levels L13 and L14 in the process. Low-pressure gas 37 expands to fill the evacuated volume. Due to the isolation of low-pressure gas 37 when valve 27 is closed, the pressure of low-pressure gas 37 drops, partially compensating for the loss of backpressure due to the decoupling of pump 15.

The end result is that a backpressure sufficient to prevent ink from dripping from inkjet printheads 11 and 12 is maintained, as indicated at method segment M5. Tests have indicated that this backpressure can be maintained indefinitely, provided liquid lost to evaporation is replenished. This replenishment can be readily accomplished by having the liquid level checked when ink is changed and adding liquid when the check indicates more liquid is required.

When vacuum pump 15 is decoupled, the backpressure falls to a limited extent. The backpressure at the end of this fall must still sufficiently overcompensate for the gravity-based pressure on the ink in inkjet head 11 to prevent dripping even in the face of small perturbations. The backpressure achieved by pumping must exceed this overcompensating level by the amount of the fall when the pump is decoupled.

However, it will not do to set the backpressure achieved by pumping too high. If the backpressure is excessive, ink flow to ink ejection chambers is reduced resulting in "ink starvation", which can degrade print quality and cause the printhead to de-prime or fail. In practice, the magnitude of the difference between the backpressure due to pumping and the backpressure due to the backpressure capacitor should be on the order of 10 mm water.

The present invention limits the drop in backpressure by providing a volume into which the confined low-pressure gas can expand. This volume is provided automatically as the increased pressure that occurs when the pump is decoupled causes capacitor interface 41 to fall. Expanding the low-pressure gas decreases its pressure and increases the backpressure applied to ink 21. Providing a greater volume for expansion reduces the loss of backpressure. The expansion volume provided is proportional (at least to a first approximation) to the area of the capacitor interface, which should be at least as great as, if not at least an order of magnitude greater than, the total of the areas of the ink interfaces in reservoirs 13 and 14. In the illustrated embodiments, the areas of the ink to low-pressure gas interfaces are 10 $mm^2$ each, for a total ink-low-pressure-gas interface area of 20 $mm^2$. The surface area of the capacitor interface 43 is 250 $mm^2$, more than an order magnitude greater than the total ink interface area.

From another perspective, the magnitude of the pump-off backpressure should exceed the gravity-based pressure on the ink in printhead by about 5-15 mm water; the magnitude of the backpressure during pumping should be about 15-25 mm greater than the gravity-based pressure. The capacitor interface should have sufficient area to limit the backpressure drop to about 10 mm water.

The liquid in the backpressure capacitor should be safe for handling and environmentally friendly. In addition, since its vapors can reach the ink reservoir, its chemistry should be compatible with the ink chemistry. Water is a good candidate. However, a lower volatility liquid may be used to reduce the frequency of maintenance operations required to compensate for evaporation. Silicone oil is a good low volatility candidate. Some embodiments use ink as the capacitor fluid and provide means for transferring capacitor ink to a printhead, e.g., via the main ink reservoir. However, most embodiments use liquids that are not ink and do not provide for transferring liquid from the capacitor to the ink reservoir or to the printhead.

The backpressure capacitor of FIG. 1 includes a U-shaped tank. Since only the low-pressure interface rises, a J-shaped tank can be used instead. Also, the liquid-gas interfaces can be in separate containers that are connected by a tube. "Low-pressure" herein refers to gas that is below ambient pressure during normal operation of a printer.

Figure 2:
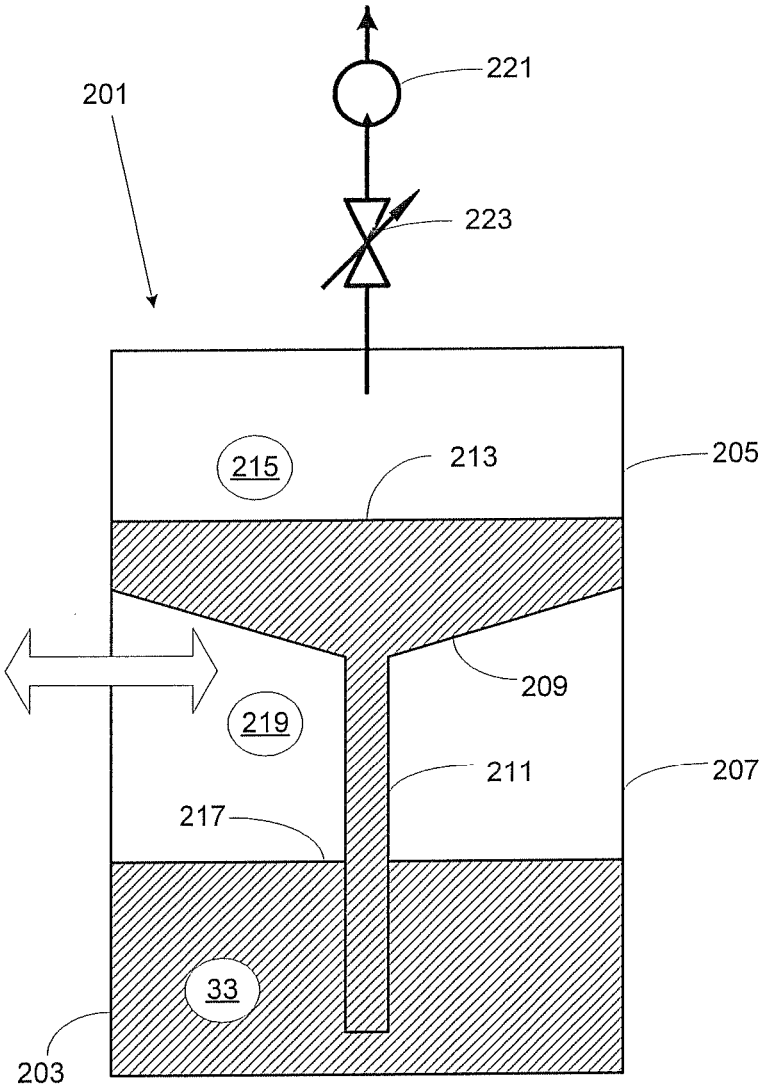
FIG. 2 is a schematic diagram of a backpressure capacitor in accordance with a second embodiment of the invention.

FIG. 2 depicts a backpressure capacitor 201 having a container structure 203 with an upper portion 205 and a lower portion 207. A base 209 of upper portion 205 converges on a tube 211 that extends deep into lower portion 207. A low-pressure interface 213 to low-pressure gas 215 is located in upper portion 205, while an ambient-pressure interface 217 to ambient-pressure gas 219 is located in lower portion 207. Low-pressure gas 215 is couplable to a pump 221 via a valve 223. Many other backpressure capacitor geometries can be used.

The invention applies to inkjet printers with a single printhead and inkjet printers with plural printhead—e.g., dedicated to respective colors such as cyan, yellow, magenta, and black. For printers with plural printheads, one vacuum system (including pump, valve, and backpressure capacitor) can serve all printheads. These and other variations upon and modifications to the illustrated embodiment are provided by the present invention, the scope of which is defined by the following claims.

The invention claimed is:

1. A method comprising:

coupling a vacuum source to one or more ink reservoirs to establish sufficient back-pressure on ink in said reservoirs to prevent ink from dripping out one or more inkjet printheads coupled to said reservoirs, and to a backpressure capacitor so that a capacitor interface between a liquid in said capacitor and a confined low-pressure gas in the backpressure capacitor rises to a first level;

decoupling said vacuum source from said ink reservoirs and said back-pressure capacitor so that said capacitor interface falls to a second level so as to maintain sufficient backpressure on said ink to prevent it from dripping from said inkjet printheads; and limiting a drop in backpressure in said ink reservoirs during decoupling by a predetermined amount by providing a volume into which said confined low-pressure gas can expand within said backpressure capacitor.

2. A method as recited in claim 1 wherein, during said coupling, an ambient interface between said liquid and an ambient-pressure gas falls to a third level and, during said decoupling, said capacitor interface rises to a fourth level.

3. A method as recited in claim 2 wherein said capacitor and ambient interfaces rise and fall by virtue of liquid moving in a U-shaped tank.

4. A method as recited in claim 2 wherein said capacitor and ambient interfaces rise and fall by virtue of liquid moving between an upper portion and a lower portion of a container structure.

5. A method as recited in claim 1 wherein said ink forms one or more ink-gas interfaces with said low-pressure gas, said ink-gas interfaces having a total ink area, said capacitor interface having a capacitor area greater than said total ink area.

6. A method as recited in claim 5 wherein said capacitor area is at least an order of magnitude greater than said total ink area.

7. A method as recited in claim 1 wherein said decoupling said vacuum source from said ink reservoirs and said back-pressure capacitor comprises turning off said vacuum source.

8. A method as recited in claim 1 wherein said liquid is water.

9. A method as recited in claim 1 wherein the predetermined amount is based on the sizes of said capacitor interface and one or more ink-gas interfaces.

10. A method as recited in claim 1 further comprising adding liquid to maintain backpressure.

11. A method as recited in claim 1 wherein said back-pressure capacitor is in gaseous communication with said ink reservoirs after decoupling.

12. A method as recited in claim 1 wherein said liquid is silicone oil.

13. An inkjet system comprising:

multiple ink reservoirs for storing ink so that said ink forms first interfaces with a low-pressure gas, said first interfaces having a total ink area;

an exhaust structure for controllably coupling said confined low-pressure gas to a vacuum source for applying a back pressure to said ink; and a backpressure capacitor containing a liquid for isolating said low-pressure gas from an ambient gas, said capacitor defining a capacitor interface between said liquid and said low-pressure gas, said capacitor interface having a capacitor area, said capacitor defining a third interface between said liquid and said ambient gas.

14. An inkjet system as recited in claim 13 further comprising:

said vacuum source, said vacuum source, when coupled to said low-pressure gas providing a backpressure to said ink and said liquid, said capacitor interface rising to a first level while said vacuum source is coupled to said low-pressure gas, said capacitor interface falling from said first level to a second level when said vacuum source is decoupled from said low-pressure gas, said second level causing sufficient backpressure to said ink to prevent it from dripping from an inkjet printhead.

15. An inkjet system as recited in claim 13 wherein said capacitor area is greater than said total ink area.

16. An inkjet system as recited in claim 15 wherein said capacitor area is at least an order of magnitude greater than said total ink area.

17. An inkjet system as recited in claim 13 wherein said backpressure capacitor includes a U-shaped tank.

18. An inkjet system as recited in claim 13 wherein said liquid is water.

19. An inkjet system as recited in claim 13 wherein said backpressure capacitor comprises a container structure comprising an upper portion and a lower portion.

20. An inkjet system as recited in claim 13 wherein said first interfaces correspond to different ink reservoirs.

* * * * *

UNITED STATES PATENT AND TRADEMARK OFFICE

CERTIFICATE OF CORRECTION

PATENT NO. : 8,814,331 B2
APPLICATION NO. : 12/997521
DATED : August 26, 2014
INVENTOR(S) : Ran Vilk et al.

It is certified that error appears in the above-identified patent and that said Letters Patent is hereby corrected as shown below:

In the Claims

In column 6, line 23, in Claim 14, before "when" delete "said vacuum source,".

Signed and Sealed this
Seventeenth Day of May, 2016

Michelle K. Lee

Michelle K. Lee
*Director of the United States Patent and Trademark Office*